United States Patent [19]

Canepa et al.

[11] Patent Number: 4,620,673

[45] Date of Patent: Nov. 4, 1986

[54] AGITATOR MILL

[75] Inventors: Giacomo Canepa, Selb; Klaus Ott, Sparneck, both of Fed. Rep. of Germany

[73] Assignee: Gebrüder Netzsch Maschinenfabrik GmbH & Co., Selb, Fed. Rep. of Germany

[21] Appl. No.: 756,994

[22] PCT Filed: Dec. 7, 1984

[86] PCT No.: PCT/EP84/00391

§ 371 Date: Jul. 11, 1985

§ 102(e) Date: Jul. 11, 1985

[87] PCT Pub. No.: WO85/02559

PCT Pub. Date: Jun. 20, 1985

[30] Foreign Application Priority Data

Dec. 16, 1983 [DE] Fed. Rep. of Germany ..... 3345680

[51] Int. Cl.[4] ..... B02C 17/16

[52] U.S. Cl. ..... 241/69; 241/172

[58] Field of Search ..... 241/172, 69, 70, 73, 241/79, 171, 46.11

[56] References Cited

U.S. PATENT DOCUMENTS 3,780,957 12/1973 Wilheim .
4,108,385 8/1978 Funk ..... 241/172 X

FOREIGN PATENT DOCUMENTS 2110336 7/1972 Fed. Rep. of Germany ..... 241/172
2098077 3/1972 France .
2245414 4/1975 France .
737004 1/1978 U.S.S.R. .

*Primary Examiner*—Mark Rosenbaum
*Attorney, Agent, or Firm*—Browdy and Neimark

[57] ABSTRACT

An agitator shaft (22) is diposed in a milling body (12) which includes a grinding chamber (18) to be filled at least partly with grinding media (50) and material (52) to be ground and has an inlet for material to be ground and an outlet for crushed material. The agitator shaft (22) has an end portion (38) in which a cavity (40) is formed which is open at the inner shaft end. The end portion (38) comprises recesses (46) all around the cavity (40) to permit grinding media (50) to flow off which entered the cavity (40) through the inner shaft end. A separating means (42) is arranged inside the cavity (40) to permit finished pulverized material (52) to flow out of the grinding chamber (18) to the outlet (30) while it retains grinding media (50). In this manner the separating means (42) is effectively protected from any direct impact of activated grinding media (50). And yet the risk is avoided that the separating means (42) becomes clogged, by virtue of the rotation of the agitator shaft (22).

21 Claims, 14 Drawing Figures

AGITATOR MILL

The invention relates to an agitator mill comprising a milling body which includes a grinding chamber to be filled at least partly with grinding media and material to be ground and has an inlet for material to be ground and an outlet for crushed material, an agitator shaft having an inner shaft end inside the grinding chamber, and a separating means permitting finished pulverized material to flow out of the grinding chamber to the outlet, yet retaining grinding media.

In a known agitator mill of this kind (DE-PS No. 2 037 358) designed as an upright agitator mill, including a vertical agitator shaft the separating means consists of a plurality of screen cartridges disposed in the upper region of the grinding chamber. In one embodiment (FIGS. 1 and 2) the grinding chamber is connected by three parallel horizontal tubes to the outlet for pulverized material flange-mounted laterally to the milling body. Through each of these tubes a screen cartridge is introduced into the grinding chamber such that one of the screen cartridges extends radially to the agitator shaft, terminating just short of the same, while two other ones which are longer are disposed at either side of the agitator shaft. In another embodiment (FIG. 3) screen cartridges are arranged offset with respect to one another in parallel with the agitator shaft and communicate with an outlet for pulverized material located above the grinding chamber. In both cases the flow of grinding media and material to be ground circulates well all around the screen cartridges so that they do not become clogged. Yet in operation the screen cartridges are constantly hit by grinding media activated directly by the agitator shaft and thus impacting at great energy of motion on the screen cartridges which, therefore, are subject to quick wear.

It is, therefore, the object of the invention to design an agitator mill such that the separating means is largely withdrawn from the grinding medium activated directly by the agitator shaft and yet does not tend to become clogged.

This object is met, in accordance with the invention, in an agitator mill of the kind specified initially in that the agitator shaft has an end portion formed with a cavity which is open at the inner shaft end, the end portion of the agitator shaft includes recesses which are distributed around the cavity and spaced from the inner shaft end and permit grinding media which entered the cavity through the inner shaft end to flow back into the grinding chamber, and the separating means is arranged at least substantially inside the cavity.

The invention has the advantage of the separating means, no matter what its particular structure may be, being arranged protectedly within the open-ended cavity formed in the end portion of the agitator shaft, whereby grinding medium activated directly by the agitator shaft hardly has a chance to collide with the separating means. And yet the risk of obstruction of the separating means is avoided by the rotation of the agitator shaft.

Preferably at least one conveying member is formed at the agitator shaft for enhancing the axial flow of the grinding medium and material to be ground from the inner shaft end through the cavity to the recesses. The conveying member may be constituted by the wall itself of the cavity, for instance by conical enlargement of the cavity away from the inner end of the shaft.

The separating means preferably is disposed at least approximately coaxially with the agitator shaft. It may also be convenient to dispose the separating means parallel or at an angle with respect to the axis of the agitator shaft, depending on the position of the agitator shaft in space and on the type and properties of the material to be ground.

The separating means may be arranged on a tube which extends through part of the grinding chamber from the inner shaft end into the cavity. This embodiment of the invention permits particularly easy assembly and disassembly of the separating means together with the tube.

Conveniently the tube is guided so as to be pulled out to the exterior in a tubular socket which extends from an end face of the milling body into the cavity.

It is likewise advantageous if the tube is guided for being pulled out to the exterior in a sleeve which is disposed at an end wall of the milling body for adjustment between a normal operating position at which it is located substantially outside of the grinding chamber and a position for exchange of the separating means, at which position the sleeve protrudes into the cavity and sealingly engages the agitator shaft in a manner so as to retain the grinding medium.

In another embodiment of the invention the separating means, regardless of its specific structure, communicates through the altogether hollow agitator shaft with the outlet for crushed material located at an outer shaft end.

As with the known agitator mill described initially, also the separating means of the subject matter of the invention may comprise a tubular screen cartridge. In this case the separating means may be fixed to the agitator shaft and rotate together with the same.

With alternative embodiments of the invention the separating means comprises two per se known separating discs which are disposed coaxially with the agitator shaft and define an annular gap, one of said separating discs being rotatable and the other one being disposed stationarily.

The invention will be described further, by way of example, with reference to diagrammatic drawings, in which.

Figure 1:
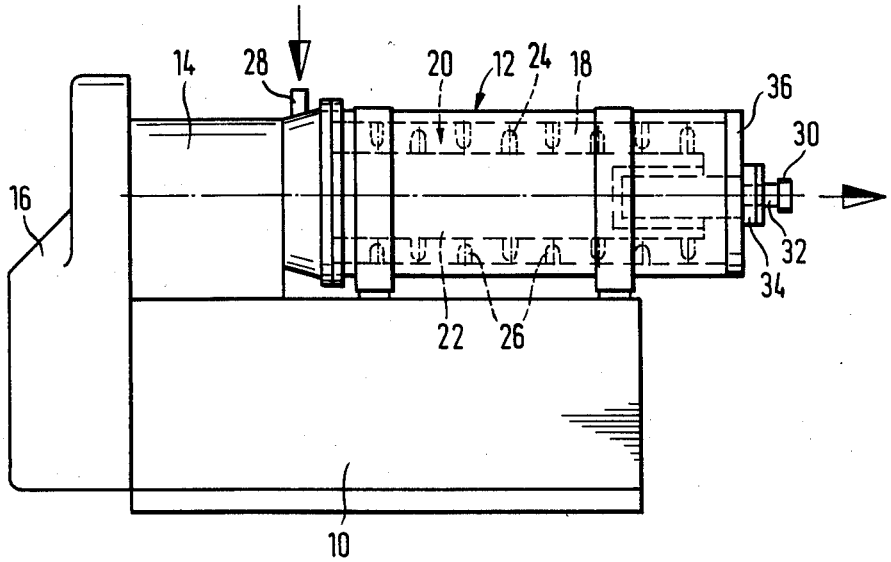
FIG. 1 is a side elevational view of an horizontal agitator mill.
Figure 2:
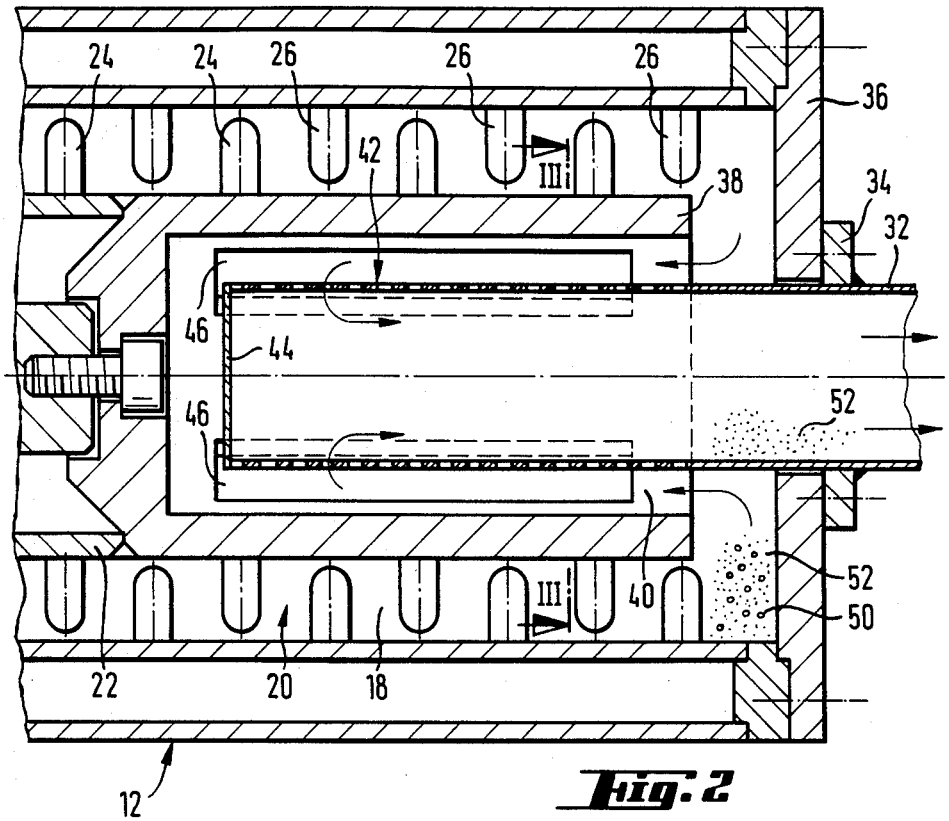
FIG. 2 is an enlarged axial sectional view of part of the agitator mill.
Figure 3:
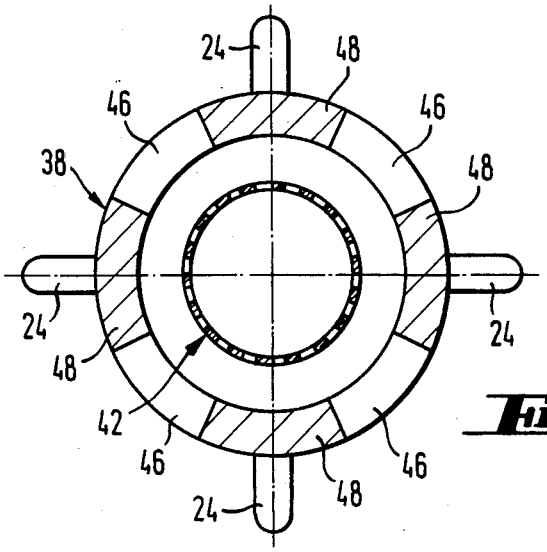
FIG. 3 is the cross sectional view III—III of FIG. 2.

The horizontal agitator mill shown in FIGS. 1 to 3 comprises a box-like frame 10 on which a substantially cylindrical milling body 12 is fixed as well as a bearing casing 14 axially adjacent the same. The frame 10 contains a drive motor (not shown) and is connected to the bearing casing 14 by a transmission casing 16 in which a gear (likewise not shown) is housed having an adjustable transmission ratio.

The milling body 12 has a circular cylindrical grinding chamber 18 in which an agitator 20 is received. The agitator 20 substantially consists of an agitator shaft 22 supported in the bearing casing 14 and extending coaxially with the milling body 12 through almost the entire grinding chamber 18 and of a number of rod-shaped agitating members 24 fixed to the agitator shaft 22 at equal axial spacings and protruding into spaces between counter-rods 26 fixed to the milling body 12.

An inlet 28 for material to be ground is disposed at the left end of the milling body 12. In operation a suspension or slurry of material to be ground and liquid is pumped continuously through this inlet into the grinding chamber 18.

An outlet 30 for finished,crushed material is arranged at the end face of the milling body 12 remote from the inlet 28, being the right end face in FIGS. 1 and 2. Finished, crushed material is constantly pumped out through this outlet. The outlet 30 is formed by a threaded socket at the end of a tube 32 to which a flange 34 is fixed. The flange 34 is connected threadedly with a cover constituting an end wall 36 of the milling body 12 at the side remote from the transmission casing 16.

The tube 32 extends through the end wall 36, in the embodiment shown coaxially with the agitator shaft 22, and passes through the adjacent area of the grinding chamber 18 up to an end portion 38 of the agitator shaft 22. The end portion 38 is releasably screwed together with the main portion of the agitator shaft 22 and comprises a cavity 40 which is open at the end face and in which a separating means 42 is arranged.

With the embodiment illustrated in FIGS. 1 to 3 the separating means 42 is formed by a cylindrical screen cartridge which has the same diameter as tube 32 and is formed integral with the same. The separating means 42 extends coaxially with the agitator shaft 22 across the major part of the length of the cavity 40 and has a closed end 44 the spacing of which from the axially inner end of the cavity 40 as well as the radial width of the annular space between the cylindrical portion of the screen cartridge and the inner wall of the end portion 38 correspond to approximately 15 to 20% of the diameter of the cavity 40.

Slot-like recesses 46 are formed in parallel with the axis in the end portion 38 and each have a cross sectional shape of a circular ring sector. They extend across the major part of the length of the cavity 40 so that the screen cartridge 42 is surrounded by these recesses almost for its entire length. In cross section, as seen in FIG. 3, the recesses extend like circular ring sectors across an angular range each of 45°, leaving webs 48 between them which have the same cross section so that the end portion 38 as a whole is similar to a cylindrical cage which is open at one end face. Three of the rod-shaped agitating members 24 each are fixed to each web 48 so that the end portion 38 is fully comparable with the main portion of the agitator shaft 22 as far as the equipment with agitating members is concerned.

In operation the agitator shaft 22 rotates at a speed which is customary in agitator mills and lies in the range of, for instance, from 200 to 3000 r.p.m., depending on the diameter of the agitator shaft and the character of the material to be ground. Hereby the mixture contained in the grinding chamber 18 of grinding media 50 and material to be ground is activated. A pumping means (not shown) produces low pressure in the tube 32 by means of which grinding media and material 52 to be ground are permitted to flow from the grinding chamber 18 into the cavity 40. The finished, crushed material passes through the screen cartridge 42 into the tube 32, whereas grinding media are retained and flow back into the grinding chamber 18 through the recesses 46. The return flow is promoted by centrifugal forces resulting from the influence of the webs 48 and the agitating members 24 fixed to the same, acting on the grinding media 50.

Figure 4:
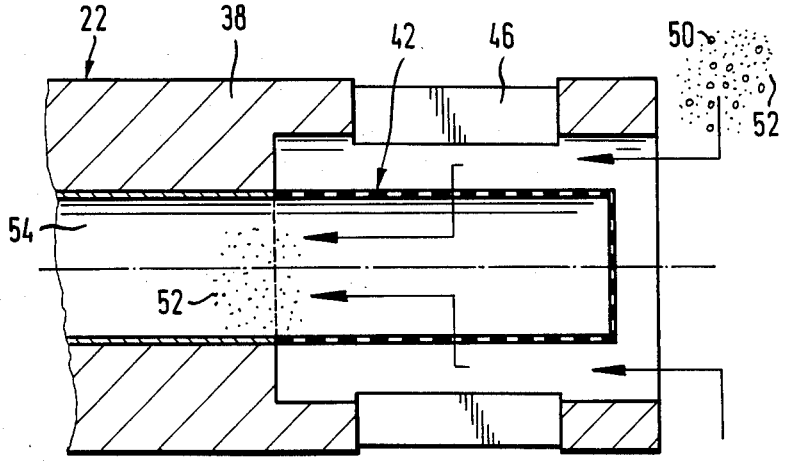
FIGS. 4 to 14 are modifications of FIG. 2.

FIG. 4 shows a simplified axial section of an embodiment in which the separating means 42 likewise is embodied by a screen cartridge and arranged in the cavity 40 of the end portion 38 of the agitator shaft 22. However, here the separating means 42 is fixed to the end of a tube 54 extending within the altogether hollow agitator shaft 22 through the bearing casing 14 (FIG. 1) where it is connected to an outlet for crushed material which replaces the outlet 30 shown for crushed material.

Figure 5:
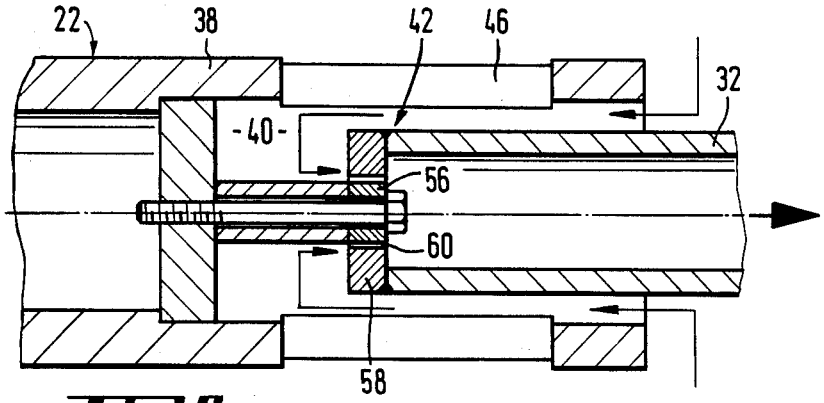
Figure 6:
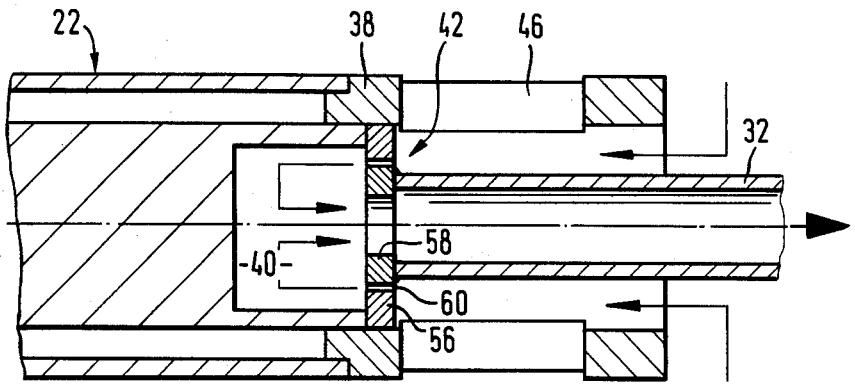

The embodiments shown in FIGS. 5 and 6 are similar in overall arrangement to FIG. 2. Again the separating means 42 is disposed at a tube 32 which extends through part of the grinding chamber 18. Yet the separating means 42 is embodied by two annular separating discs 56 and 58 arranged coaxially with the agitator shaft 22 and defining a cylindrical annular gap 60 between them. The separating disc 56 is secured to the agitator shaft 22 and rotates together with the same; the separating disc 58 is secured to the tube 32, thereby being stationary.

According to FIG. 5 the stationary separating disc 58 is disposed radially outwardly and the rotatable separating disc 56 radially inwardly; the opposite is the case in FIG. 6.

Figure 7:
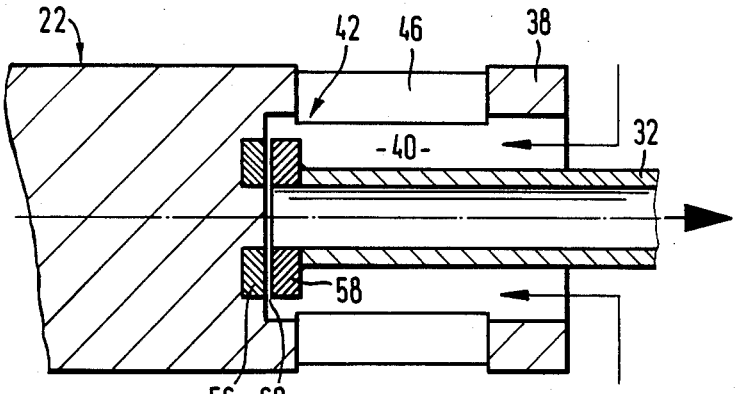

FIG. 7 shows a modification which differs from FIGS. 5 and 6 in that the two separating discs 56 and 58 have approximately the same size and are positioned axially opposite each other so that they define a substantially planar radial annular gap 60. The separating discs 56 and 58 also could be conical, defining between them a likewise conical annular gap.

Figure 8:
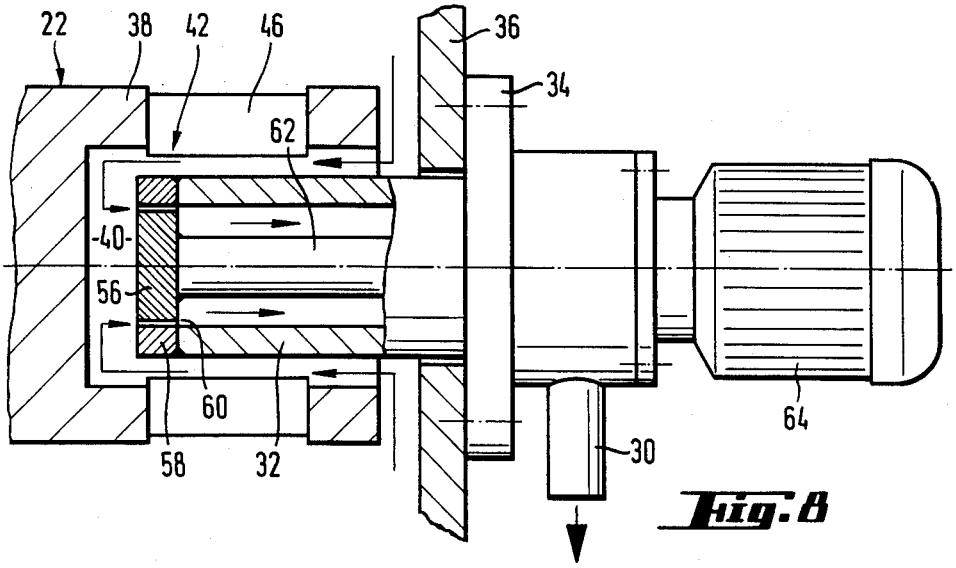
Figure 9:
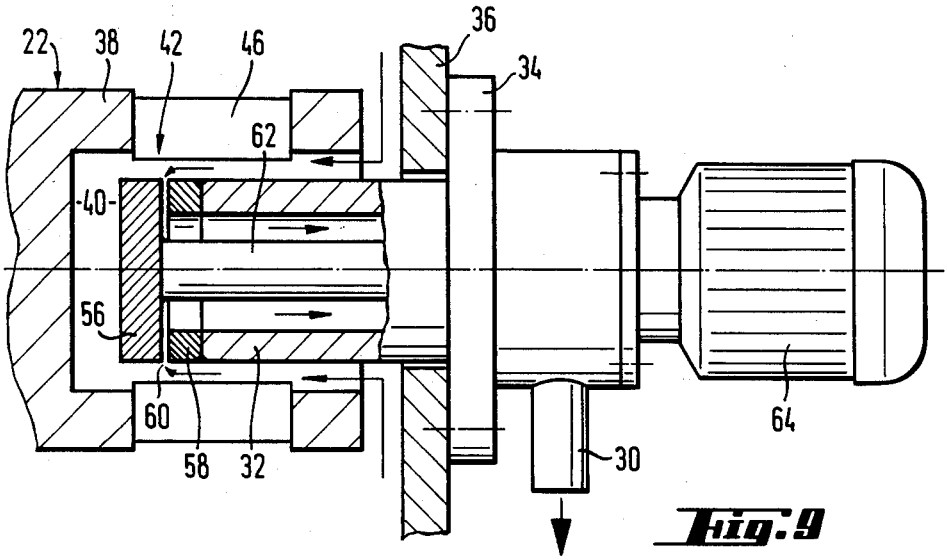

FIGS. 8 and 9 show two further embodiments with which the separating means 42 likewise formed by two separating discs 56 and 58 does not include a structural member which rotates together with the agitator shaft 22. The rotatable separating disc 56 is secured to a shaft 62 arranged coaxially with the agitator shaft 22 inside the tube 32 and adapted to be driven by a motor 64 of its own which is flange-mounted on the end wall 36. The stationary separating disc 58 each is fixed to the tube 32, radially outside of the rotating disc 56 in FIG. 8 and axially next to the same in the case of FIG. 9.

Figure 10:
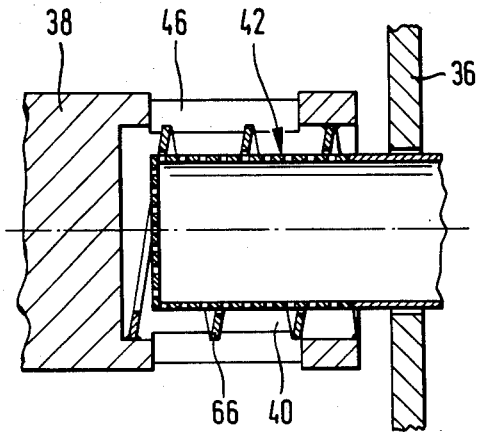

As shown in FIG. 10, a conveying member 66 in the form of a helix is arranged around the separating means 42 which again is embodied by a screen cartridge. It is fixed to the end portion 38 of the agitator shaft 22 within the cavity 40.

The helix is so designed that the conveying member 66 feeds grinding media 50 and material 52 to be ground within the cavity 40 away from the open end thereof, i.e. to the left in FIG. 10 when the agitator shaft 22 is driven in the direction of its operational rotation. As a consequence grinding media 50 and material 52 to be ground flow substantially uniformly around the screen cartridge constituting the separating means 42.

Figure 11:
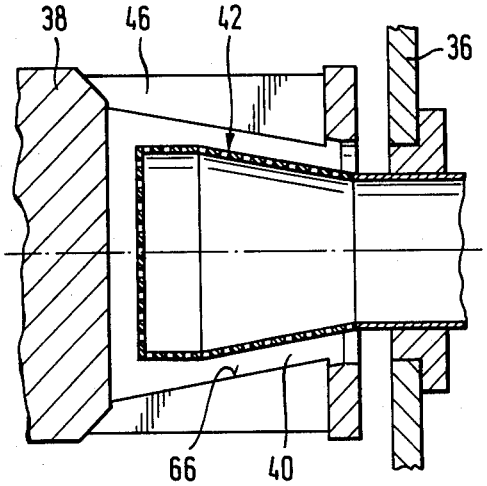

In FIG. 11 the inner wall of the hollow end portion 38 is seen to diverge frustoconically away from the open end of the cavity 40. When the agitator shaft 22 is rotating this design has the effect that the centrifugal forces acting on the grinding media 50 and material 50 to be ground generate propelling forces in the direction of enlargement of the cavity 40, in other words away from the open end thereof. Thus the inner wall of the end portion 38 itself presents a conveying member 66. The separating means 42 again embodied by a screen cartridge is enlarged in correspondence with the cavity 40, yet only to a diameter which is a little smaller than the smallest inner diameter of the cavity 40. Thus the separating means 42 can be pulled axially out of the end portion 38 for replacement, as with all other embodiments.

The conveying members 66 shown in FIGS. 10 and 11 may be combined with each other.

Figure 12:
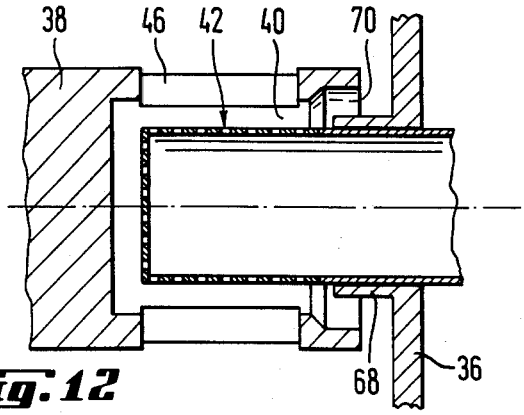

Exchange of the separating means 42 while the agitator mill is running yet the pumping means is shut off and without any grinding media 50 falling out is provided for in accordance with FIG. 12 by the provision of a tubular socket 68 at the end wall 36 or a similar closing member of the milling body 12. In this tubular socket 68 the separating means 42 once more in the form of a screen cartridge is guided in a manner so as to be pulled out. The tubular socket 68 extends into an enlargement 70 of the cavity 40, yet it terminates at or just before the beginning of the recess 46 so that, during normal operation, it does not impede the flow of grinding media 50 and material 52 being ground through the cavity 40 and the recesses 46.

Figure 13:
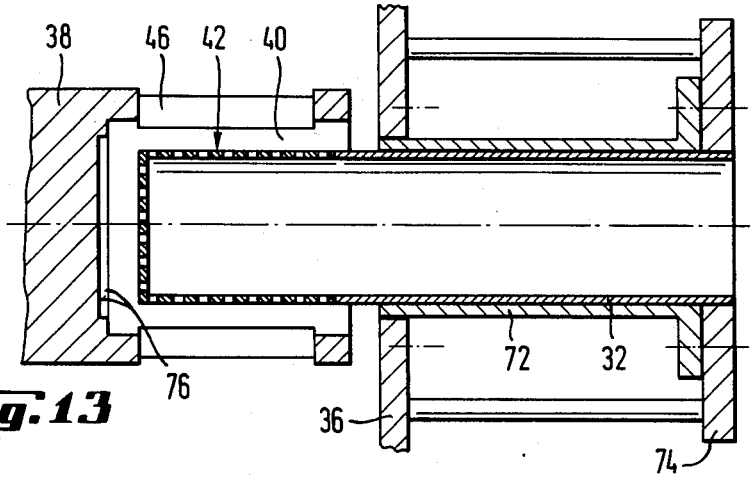
Figure 14:
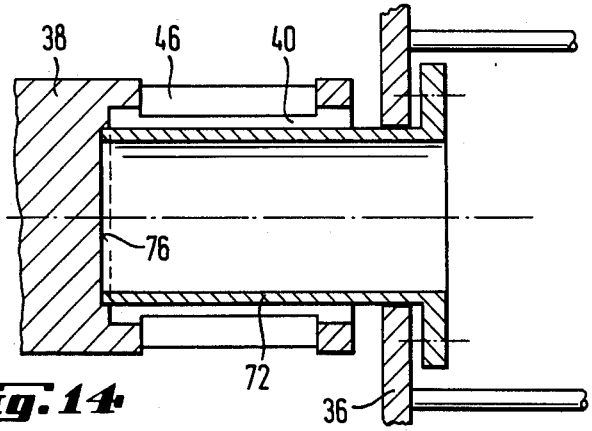

The stationary tubular socket 68 shown in FIG. 12 may be replaced, as illustrated in FIGS. 13 and 14, by a sleeve 72 guided for axial displacement at the end wall 36 and/or a holder 74 fixed to the same. In FIG. 13 the normal operating position is shown at which the sleeve 72 does not protrude into the grinding chamber 18 or does so only a little. As shown in FIG. 14, the sleeve 72 may be displaced into a position in which it engages in a hollow 76 formed in the end portion 38. Hereby the interior of the sleeve 72 is separated altogether tightly from the surrounding cavity 40 and from the grinding chamber 18. The sleeve 72 can be fastened in this position so that the separating means 42 is exchangeable while the agitator shaft 22 is running, and yet no grinding media 50 or material 52 being ground can flow out.

What is claimed is:

1. An agitator mill comprising a milling body (12) which includes a grinding chamber (18) to be filled at least partly with grinding media (50) and material (52) to be ground and has an inlet (28) for material to be ground and an outlet (30) for crushed material, an agitator shaft (22) having an inner shaft end inside the grinding chamber (18), and a separating means (42) permitting finished pulverized material (52) to flow out of the grinding chamber (18) to the outlet (30) yet retaining grinding media (50), wherein the agitator shaft (22) has an end portion (38) formed with a cavity (40) therein which is open at the inner shaft end, the end portion (38) of the agitator shaft (22) includes recesses (46), distributed around the cavity (40) and spaced from the inner shaft end, through which said grinding media (50) from said grinding chamber (18) may axially flow into the cavity (40) and through the inner shaft end to flow back into the grinding chamber (18), and the separating means (42) is arranged at least substantially inside the cavity (40).

2. The agitator mill as claimed in claim 1, characterized in that at least one conveying member (66) is formed at the agitator shaft (22) to promote axial flow of grinding media (50) and material (52) to be ground from the inner shaft end through the cavity (40) to the recesses (46).

3. The agitator mill as claimed in claim 2, characterized in that the separating means (42) is arranged at least approximately coaxially with the agitator shaft (22).

4. The agitator mill as claimed in claim 3, characterized in that the separating means (42) is arranged on a tube (32) which extends through part of the grinding chamber (18) from the inner shaft end into the cavity (40).

5. The agitator mill as claimed in claim 4, characterized in that the separating means (42) communicates through the altogether hollow agitator shaft (22) with the outlet (30) for crushed material disposed at an outer shaft end.

6. The agitator mill as claimed in claim 4, characterized in that the tube (32) is guided so as to be pulled out to the exterior in a tubular socket (68) which extends from an end face (36) of the milling body (12) into the cavity (40).

7. The agitator mill as claimed in claim 1, characterized in that the tube (32) is guided so as to be pulled out to the exterior in a sleeve (72) which is arranged at an end wall (36) of the milling body (12) and is adjustable between a normal operating position in which it is disposed substantially outside of the grinding chamber (18) and a position for exchange of the separating means (42), at which position the sleeve (72) protrudes into the cavity (40) and affords sealing against the agitator shaft (22) in a manner to retain the grinding media (50).

8. The agitator mill as claimed in claim 7, characterized in that the cavity (40) diverges frustoconically away from the inner shaft end.

9. The agitator mill as claimed in claim 2 characterized in that the cavity (40) diverges frustoconically away from the inner shaft end.

10. The agitator mill as claimed in claim 9, characterized in that the separating means (42) communicates through the altogether hollow agitator shaft (22) with the outlet (30) for crushed material disposed at an outer shaft end.

11. The agitator mill as claimed in claim 1, characterized in that the separating means (42) is arranged at least approximately coaxially with the agitator shaft (22).

12. The agitator mill as claimed in claim 11, characterized in that the separating means (42) communicates through the altogether hollow agitator shaft (22) with the outlet (30) for crushed material disposed at an outer shaft end.

13. The agitator mill as claimed in claim 11, characterized in that the separating means (42) comprises separating discs (56,58) which are disposed coaxially with the agitator shaft (22) and define an annular gap (60) and of which one is rotatable while the other one is stationary.

14. The agitator mill as claimed in claim 11, characterized in that the separating means (42) is arranged on a tube (32) which extends through part of the grinding chamber (18) from the inner shaft end into the cavity (40).

15. The agitator mill as claimed in claim 14, characterized in that the tube (32) is guided so as to be pulled out to the exterior in a tubular socket (68) which extends from an end face (36) of the milling body (12) into the cavity (40).

16. The agitator mill as claimed in claim 15, characterized in that the tube (32) is guided so as to be pulled out to the exterior in a sleeve (72) which is arranged at an end wall (36) of the milling body (12) and is adjustable between a normal operating position in which it is disposed substantially outside of the grinding chamber (18) and a position for exchange of the separating means (42), at which position the sleeve (72) protrudes into the cavity (40) and affords sealing against the agitator shaft (22) in a manner to retain the grinding media (50).

17. The agitator mill as claimed in claim 1, characterized in that the separating means (42) communicates through the altogether hollow agitator shaft (22) with the outlet (30) for crushed material disposed at an outer shaft end.

18. The agitator mill as claimed in claim 17, characterized in that the separating means (42) comprises separating discs (56,58) which are disposed coaxially with the agitator shaft (22) and define an annular gap (60) and of which one is rotatable while the other one is stationary.

19. The agitator mill as claimed in claim 17, wherein the separating means (42) comprises a screen cartridge, characterized in that the separating means (42) is fixed to the agitator shaft (22) and rotates together with the same.

20. The agitator mill as claimed in claim 1, characterized in that the separating means (42) comprises per se known separating discs (56,58) which are disposed coaxially with the agitator shaft (22) and define an annular gap (60) and of which one is rotatable while the other one is stationary.

21. The agitator mill of claim 1, wherein at least a portion of said separating means is concentrically rotatable within said agitator shaft.

* * * * *